US006115893A

United States Patent [19]

Linz

[11] Patent Number: 6,115,893

[45] Date of Patent: Sep. 12, 2000

[54] PROCESS AND DEVICE FOR PRODUCING INDUSTRIAL POLYESTER YARN

[75] Inventor: Hans Linz, Kriens, Switzerland

[73] Assignee: Rhodia Filtec AG, Emmenbruecke, Switzerland

[21] Appl. No.: 09/284,110

[22] PCT Filed: Dec. 11, 1997

[86] PCT No.: PCT/CH97/00463

§ 371 Date: Apr. 7, 1999

§ 102(e) Date: Apr. 7, 1999

[87] PCT Pub. No.: WO98/28473

PCT Pub. Date: Jul. 2, 1998

[30] Foreign Application Priority Data

Dec. 20, 1996 [CH] Switzerland ..... 3147/96

[51] Int. Cl.[7] ..... D02J 1/22

[52] U.S. Cl. ..... 28/240; 28/245

[58] Field of Search ..... 28/240, 245, 246, 28/244; 57/310; 264/290.5, 290.7, 210.8; 425/66

[56] References Cited

U.S. PATENT DOCUMENTS

| | | | |
|---|---|---|---|
| 2,604,667 | 7/1952 | Hebeler | 18/54 |
| 3,159,964 | 12/1964 | Kretsch | 28/71.3 |
| 3,715,421 | 2/1973 | Martin et al. | 28/245 |
| 3,766,614 | 10/1973 | Coats et al. | 28/246 |
| 3,790,995 | 2/1974 | Martin et al. | 28/245 |
| 4,461,740 | 7/1984 | Koschinek et al. | 28/245 |
| 4,610,060 | 9/1986 | Phillips et al. | 28/246 |

*Primary Examiner*—Amy B. Vanatta
*Attorney, Agent, or Firm*—Michael J. Striker

[57] ABSTRACT

The method of producing an industrial yarn at a production speed of from 3000 to 6000 m/min includes melt-spinning a plurality of polyester filaments; stretching a thread made from the filaments by means of a delivery assembly (1) and a drawing roller system (2); providing at least one thread-braking device (3) including at least one deflecting roller (31, 32) between the delivery assembly (1) and the drawing roller system (2); deflecting and decelerating the thread between the delivery assembly and the drawing roller system by means of the at least one thread-braking device (3) and looping the thread only once around the at least one deflecting roller (31,32) of the at least one thread-braking device (3). The at least one deflecting roller (31, 32) is braked to a circumferential speed ($v_3$) given by the following formula $v_3=v_1+(v_2-v_1)^* F$, wherein $0.5 \leqq F<1$, $v_1$=the delivery assembly speed and $v_2$=the drawing roller system speed.

6 Claims, 1 Drawing Sheet

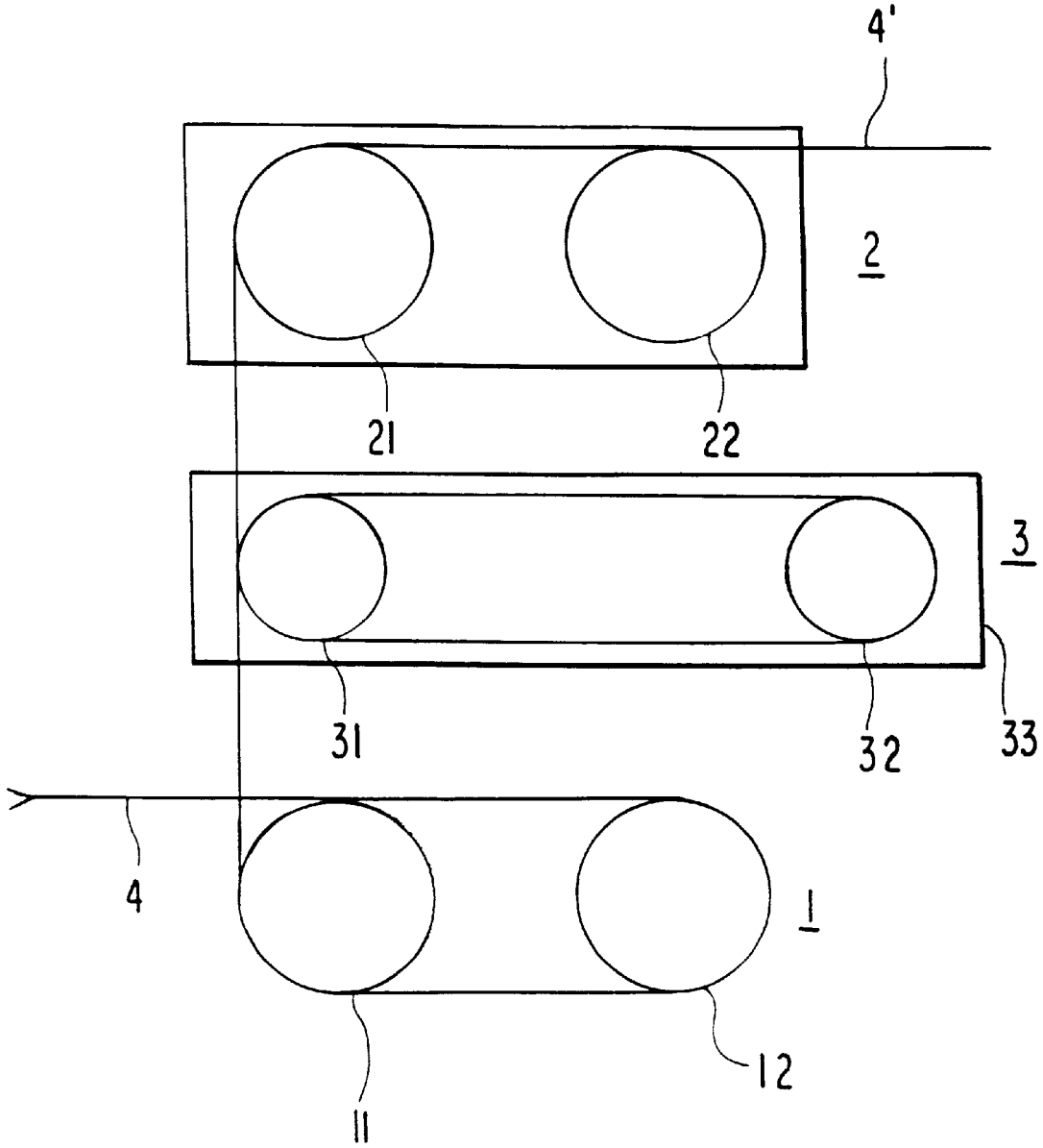
4'
2
21
22
3
31
32
33
4
1
11
12

PROCESS AND DEVICE FOR PRODUCING INDUSTRIAL POLYESTER YARN

BACKGROUND OF THE INVENTION

1. Field of the Invention

The present invention relates to a method and an apparatus for the production of industrial yarns by the stretch-spinning of melt-spun polyester filaments at speeds of 3000 to 6000 m/min, stretching being carried out by means of a delivery assembly and a drawframe.

2. Prior Art Drawing Roller System

Polyester for use in the industrial sector, that is to say in an overall linear density range above 500 dtex and with a strength of at least 60 cN/tex, are produced predominantly by the stretch-spinning method which has proven highly cost-effective. Further cost savings can be achieved by increasing the productivity of the plants by raising the production speed to final speeds in the range of 6000 m/min and above. It has been shown, in addition, that filaments with new properties can also be obtained by increasing the spinning speed.

A stretch-spinning method of this type is known from U.S. Pat. No. 3,790,995. A single-stage stretch-spinning method for the production of polyester filaments is described there. This method is based on stretching between two pairs of galettes, such that, due to the absence of frictional connection between the thread and the galette surface, the stretching process on the thread commences as early as a few loopings prior to the thread leaving the delivery assembly. The stretching process is likewise terminated only a few loopings after the thread has run onto the drawing roller system. This is made possible by the roughened thread-touching surfaces of the galettes, which allows slip between the filament and the roller surface. The stretching zone is thereby effectively lengthened to a multiple of the geometrical distance between the pairs of galettes. More time is also available correspondingly for the orientation of the macromolecules forming the thread mass. A higher degree of orientation is thus achieved than when roller surfaces which are highly polished are used. Highly polished surfaces allow a maximum frictional connection between the thread and the roller surface.

Now it has been shown that, by increasing the production speed above 3000 m/min, this method no longer works optimally, since the time available for orientation is no longer sufficient. Orientation decreases in inverse proportion to the production speed. The time finally becomes so short that the high degrees of orientation necessary for use as industrial yarns can no longer be achieved. The degree of orientation is responsible for correspondingly low elongation at break and high strength of the stretched filament yarn.

The following disadvantages arise:

Lengthening the stretching time by increasing the distance between the pairs of galettes has the critical disadvantage that the overall height of the production apparatus would have to be increased to an unacceptable extent, so that the plant could no longer be operated without aids, such as lifting platforms and the like. Although the distance between the pairs of galettes can be reduced by deflecting the thread run once or more than once within the stretching zone, this nevertheless entails some serious disadvantages. Deflections within the stretching zone by means of thread guide members are undesirable and present problems. On account of the high thread pull prevailing in the stretching zone, deflecting pins and the like become very hot and lead to broken filaments even after a short operating time. Although the thread run between the pairs of galettes can be increased by means of non-driven deflecting rollers, numerous filaments breaks which make the method inefficient occur in this case. The use of deflecting rollers with a structured surface, which is known to prevent broken filaments from accumulating to form a deposit, has also not afforded any progress in this respect.

SUMMARY OF THE INVENTION

The set object, therefore, is, for the purpose of increasing the production speed, to take measures and provide means which, despite the reduced stretching time, bring about in the filament yarn a molecular orientation which is sufficiently high for industrial use.

A further object of the invention is to provide a method which allows more efficient production of industrial yarns.

A further object is to provide an improved apparatus, by means of which highly oriented industrial yarns can be produced.

The object is achieved, according to the invention, in that the thread is deflected between the delivery assembly and the drawing roller system and is decelerated by means of at least one thread-braking device. Thread deflection is brought about by braked rollers.

Surprisingly, it was possible to achieve a marked improvement by braking the deflecting rollers of the thread-braking device to a speed $v_3$ which satisfies the following condition:

$$v_3=v_1+(v_2-v_1)*F,$$

in which the factor F is in any event less than 1, preferably in the range of $0.6 \leqq F <= 0.95$ and, especially preferably, in the range of $0.7 \leqq F <= 0.9$. The quantities $v_1$ and $v_2$ denote the speeds of the delivery assembly and of the drawframe, respectively. The speed must therefore be lower than the thread running speed at the point at which the threads touch the deflecting rollers. This can be carried out only by means of rollers provided with a structured surface which allows slip between the thread and roller surface.

A further improvement in stretchability has been achieved by additionally heating the deflecting rollers to a casing temperature of between 150 and 210° C.

It has proved advantageous, furthermore, to arrange the entire deflecting system within a housing which is thermally insulated relative to the surroundings, in order to prevent the thread from cooling in the stretching zone.

There is a different number of deflecting rollers required, depending on how the thread path is extended. Under some circumstances, one deflecting roller, around which the thread is looped over just 180°, is sufficient.

Arranging two rollers in a similar way to the arrangement of a conventional pair of galettes has proved advantageous. The thread may be looped around such an arrangement in either an S-shaped or 8-shaped or 0-shaped manner. As a result, without changing the design of the device, the effective contact length between the thread and roller surfaces can be varied within particular limits and be adapted to the conditions required for the method. As a rule, the thread is looped around the rollers once only in each case. Double looping may be advantageous under some circumstances, when the frictional connection between the thread and roller surface is very low.

The advantage of this procedure is, above all, that the deflecting rollers can be very short, since they have to provide space for only one and, at most, two thread running tracks. This is beneficial in investment terms, since the costs of rollers with a larger working width, such as are required for multiple loopings, are very much higher.

BRIEF DESCRIPTION OF THE DRAWING

The objects, features and advantages of the invention will now be illustrated in more detail with the aid of the following description of the preferred embodiment, with reference to the sole FIGURE which is a diagram of an apparautus for performing the method of producing industrial yarns according to the invention.

In the single FIG. 1, 1 denotes a delivery assembly consisting of a heatable driven galette 11 and of a heatable galette 12. A drawing roller system 2 consists of a heatable driven galette 21 and of a heatable driven galette 22. A thread-braking device 3 is arranged between the delivery assembly 1 and the drawing roller system 2. The thread-braking device 3 is equipped with a heatable and brakable deflecting roller 31 and, according to choice, with a heatable and brakable deflecting roller 32, both deflecting rollers being located within a thermally insulated housing 33. The unstretched filament 4 comes in a known way from a known spinning device (not shown); the stretched filament 4' is received in a known way by a winding device (not shown), for example a bobbin winder.

When the method according to the invention is being carried out, the thread-braking device 3 forms the extension of the intermediate stretching zone. The filament 4 comes, in a way not shown, from a conventional device for melt-spinning, cooling and preparation, is looped more than once around the delivery assembly 1 running at a circumferential speed $v_1$, said filament being heated according to the set casing temperature, then arrives at the thread-braking device 3, of which the deflecting rollers 31, 32 braked to the circumferential speed $v_3$ are looped once, and is finally stretched by the drawing roller system 2, running at the circumferential speed $v_2$, according to a set speed ratio ($v_2/v_1$). Subsequently, the filament 4' is wound up in the conventional way, if appropriate after running through a further pair of galettes (not shown).

The deflecting rollers 31, 32 should not be smooth. They have a structured surface, in order to allow slip between the filament 4 and the roller surface. The mean peak-to-valley height of the surface of the deflecting rollers 31, 32 is expediently in the range of 2.5 to 3.5 micrometers. In order to reduce abrasion, the surface is expediently a hard-metal surface or a coating with ceramic or other abrasion-resistant materials. In order to avoid fibril damage, the surface structure must be free of sharp elevations. It is expediently structured as "orange skin".

The necessary braking of the deflecting rollers 31 and 32 may take place purely mechanically. It is advantageous for the reliability and reproducibility of the method if the circumferential speed of the deflecting rollers 31 and 32 is kept constant by means of a known regulating device. The use of controlled frequency drives has proved particularly appropriate. However, drive units of this type must be equipped with a device for recovering the braking power or with another type of energy dissipation. The necessary braking power may amount to 1 watt/dtex of the stretched filament, depending on the stretching conditions.

The method according to the invention will be explained by means of the following examples.

EXAMPLE 1

Polyethylene terephthalate with a viscosity index VI=114 was melted in an extruder and extruded through two spinnerets, each having 256 bores. The melt throughput per bore was 2.45 g/min. The melt jets were cooled in the conventional way and provided with a water-free preparation agent. They were subsequently combined into two filament bundles and drawn off from the spinning well at a speed $v_1$ of 3100 m/min by means of the delivery assembly 1 having galettes 11, 12 heated to 120° C. The threads 4 were looped around the delivery assembly 1 six times. Subsequently, after being looped once around the deflecting rollers 31, 32 of the thread-braking device 3, the threads 4 were fed to the drawing roller system 2 which was heated to 240° C. and ran at a circumferential speed $v_2$ of 5710 m/min. The threads 4 were looped around the stretching galettes 21, 22 eight times. The stretching zone between the delivery assembly 1 and drawing roller system 2 was extended by 1.5 m by means of the deflecting device 3. The deflecting rollers 31, 32 had a diameter of 190 mm and were provided with a ceramic-coated surface having a mean peak-to-valley height of 3.5 micrometers. They were heated to a temperature of 180° C. and were braked to a speed $v_3$ of 5190 m/min with a braking torque of 1 Nm in each case. The total braking power was 1.82 kW.

After stretching by the factor 1.84 had taken place in this way, the threads were cooled on a further pair at 120° C. and finally wound up with a tension of 250 cN. The filaments had a linear density of 1100 dtex.

EXAMPLE 2

Polyethylene terephthalate of the same type as in Example 1 was melted, spun and stretched in the same way, the difference being that the melt throughput was 3.21 g/min. This resulted in a final linear density of the stretched yarn of 1440 dtex. The deflecting rollers 31, 32 of the thread-braking device 3 had to be subjected to a braking torque of 1.25 Nm in each case, in order to obtain the same circumferential speed as in Example 1. The total braking power was 2.28 kW.

EXAMPLE 3 (comparative example)

The test from Example 1 according to the invention was repeated, but without using the thread-braking device 3. In this case, it was possible for the filaments to be drawn in on the drawing roller system only after the stretching ratio had been reduced to 1.7. However, the stretch-spinning run was seriously disrupted by the occurrence of numerous broken filaments.

EXAMPLE 4

Polyester granulate (polyethylene terephthalate) with a viscosity index of 114 was extruded, as in Example 1, and spun into two filament yarns each having 256 filaments. The multifilaments were drawn off from the spinning well at 3100 m/min. The optical double refraction (DB) of the filaments spun in this way was 0.065. The filament yarns were fed at 3130 m/min at a temperature of 80° C. to a delivery assembly 1, around which they were looped six times. The drawing roller system 2 had a circumferential speed of 5776 m/min and a temperature of 240° C. The threads were looped around it eight times. The thread-braking device consisted of the two electrically braked deflecting rollers 31, 32 which were at a temperature of 200° C. within a thermally insulated housing and around which the filaments were looped once. They were braked to a speed of 5247 m/min. After being stretched, the filament was cooled at 120° C. on a further pair of galettes which ran at the same speed as the drawing roller system. The filament was subsequently wound up at 5600 m/min. The filament yarn treated in this way had the following properties:

| | | |
|---|---|---|
| Linear density | 1100 | dtex |
| Strength | 67.2 | cN/tex |
| Elongation at break | 14.2 | % |
| LASE 2% | 14.8 | cN/tex |
| LASE 5% | 34.5 | cN/tex |
| Thermal shrinkage at 160° C. | 6.7 | % |

The yarn is particularly suitable for use in tire cord.

I claim:

1. A method of producing an industrial yarn at a production speed of from 3000 to 6000 m/min, said method comprising a) melt-spinning a plurality of polyester filaments;

b) stretching a thread comprising the filaments by means of a delivery assembly (1) and a drawing roller system (2);

c) providing at least one thread-braking device (3) including at least one deflecting roller (31, 32) between the delivery assembly (1) and the drawing roller system (2);

d) deflecting and decelerating the thread between the delivery assembly (1) and the drawing roller system (2) by means of the at least one thread-braking device (3); and e) looping the thread only once around the at least one deflecting roller (31,32) of the at least one thread-braking device (3);

whereby said at least one deflecting roller (31, 32) is braked to a circumferential speed ($v_3$) given by the following formula:

$$v_3=v_1+(v_2-v_1)*F,$$

wherein $0.5 \leqq F<1$, $v_1$=circumferential speed of the delivery assembly (1) and $v_2$=circumferential speed of the drawing roller system (2).

2. The method as defined in claim 1, further comprising heating the at least one deflecting roller (31,32) and arranging said at least one thread-braking device (3) in a thermally insulated housing (33).

3. The method as defined in claim 1, further comprising heating the at least one deflecting roller (31,32) to a casing temperature between 150 and 210° C.

4. An apparatus for producing an industrial yarn at a production speed of from 3000 to 6000 m/min by a method comprising melt-spinning a plurality of polyester filaments; stretching a thread comprising the filaments by means of a delivery assembly (1) and a drawing roller system (2); providing at least one thread-braking device (3) including at least one deflecting roller (31, 32) between the delivery assembly (1) and the drawing roller system (2); deflecting and decelerating the thread between the delivery assembly (1) and the drawing roller system (2) by means of the at least one thread-braking device (3); and looping the thread only once around the at least one deflecting roller (31,32) of the at least one thread-braking device (3); whereby said at least one deflection roller (31, 32) is braked to a circumferential speed ($v_3$) given by the following formula:

$$v_3=v_1+(v_2-v_1)*F,$$

wherein $0.5 \leqq F<1$, $v_1$=circumferential speed of the delivery assembly (1) and $v_2$=circumferential speed of the drawing roller system (2); said apparatus comprising said delivery assembly (1), said drawing roller system (2) and said at least one thread-braking device (3) with said at least one deflecting roller (31), said at least one thread-braking device (3) being arranged between said delivery assembly (1) and said drawing roller system (2), wherein said at least one deflecting roller (31, 32) has a structured roller surface formed so that slip is permitted between the thread (4) and the roller surface.

5. The apparatus as defined in claim 4, wherein said at least one thread-braking device (3) is arranged in a thermally insulated housing.

6. The apparatus as defined in claim 4, wherein said roller surface has peaks and valleys and a mean peak-to-valley height in a range of from 2.5 to 3.5 micrometers.

* * * * *